US011465427B2

(12) United States Patent
Chia et al.

(10) Patent No.: US 11,465,427 B2
(45) Date of Patent: Oct. 11, 2022

(54) MEDIA CATCHERS

(71) Applicant: HEWLETT-PACKARD DEVELOPMENT COMPANY, L.P., Spring, TX (US)

(72) Inventors: Wesley Chia, Singapore (SG); Hock-Yong Cheng, Singapore (SG); Chin-Siang Chua, Singapore (SG); Alberto Arredondo Rosales, Sant Cugat del Valles (ES); Rodrigo Ruiz, Sant Cugat del Valles (ES); Alberto Borrego Lebrato, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 8 days.

(21) Appl. No.: 17/047,677

(22) PCT Filed: May 25, 2018

(86) PCT No.: PCT/US2018/034685

§ 371 (c)(1),
(2) Date: Oct. 14, 2020

(87) PCT Pub. No.: WO2019/226176

PCT Pub. Date: Nov. 28, 2019

(65) Prior Publication Data

US 2021/0155018 A1 May 27, 2021

(51) Int. Cl.
*B41J 11/58* (2006.01)
*B65H 31/02* (2006.01)
(Continued)

(52) U.S. Cl.
CPC ..... *B41J 11/58* (2013.01); *B65H 31/02* (2013.01); *B65H 31/22* (2013.01); *B65H 31/24* (2013.01);
(Continued)

(58) Field of Classification Search
CPC ..... B41J 13/10; B41J 13/105; B41J 11/58; B65H 31/22; B65H 31/24; B65H 2405/22; B65H 2405/351
See application file for complete search history.

(56) References Cited

U.S. PATENT DOCUMENTS 3,154,356 A 10/1964 Lewis
3,474,912 A * 10/1969 Paul ..... G03B 27/585 211/50
(Continued)

FOREIGN PATENT DOCUMENTS

CN 1526624 9/2004
CN 203582106 5/2014
(Continued)

*Primary Examiner* — Leslie A Nicholson, III
(74) *Attorney, Agent, or Firm* — HP Inc. Patent Department

(57) ABSTRACT

In an example, a media catcher may include a first frame member and a second frame member spaced away from the first frame member along a lateral direction, thereby defining a catcher width of the media catcher. Additionally, the media catcher may also include a device interface disposed at a top end of the first frame member or the second frame member. The device interface may attach the media catcher to an imaging device. The media catcher may further include a catch panel extending between the first frame member and the second frame member to catch and support media.

20 Claims, 7 Drawing Sheets

(51) Int. Cl.
*B65H 31/22* (2006.01)
*B65H 31/24* (2006.01)

(52) U.S. Cl.
CPC .... *B65H 2405/22* (2013.01); *B65H 2405/351* (2013.01); *B65H 2511/12* (2013.01); *B65H 2701/11312* (2013.01); *B65H 2801/36* (2013.01)

(56) References Cited

U.S. PATENT DOCUMENTS 3,704,793 A * 12/1972 Nicol ..... B65H 29/22 271/178
4,221,379 A 9/1980 Kamath
4,823,963 A * 4/1989 Helmetsie ..... G03B 27/62 211/126.1
4,995,602 A * 2/1991 Nakadai ..... H04N 1/00567 271/207
5,190,167 A 3/1993 Andrews
5,207,417 A * 5/1993 Bell ..... B65H 29/40 271/175
5,913,628 A * 6/1999 Sides, II ..... B65H 31/22 400/679
5,924,808 A 7/1999 Sides, II
6,209,864 B1 4/2001 Taniguchi
6,824,129 B2 11/2004 Sides
6,832,865 B2 * 12/2004 Motamed ..... B65H 31/10 271/219
7,556,261 B2 * 7/2009 Luquet ..... B43M 3/02 271/207
7,942,414 B2 * 5/2011 Taki ..... B65H 33/08 271/279
2003/0185614 A1 10/2003 Motamed
2004/0085426 A1 5/2004 Cuyler

FOREIGN PATENT DOCUMENTS

JP S57155146 9/1982
JP 6124532 7/1986
JP H-0439256 A 2/1992
JP H10120275 5/1998

* cited by examiner

MEDIA CATCHERS

BACKGROUND

Imaging devices may perform imaging operations such as printing or copying with print media. Print media may enter an imaging device through a media input, and exit the imaging device through a media output after undergoing an imaging operation. Print media may be captured by an output tray or basket after exiting the imaging device.

DETAILED DESCRIPTION

Figure 1:
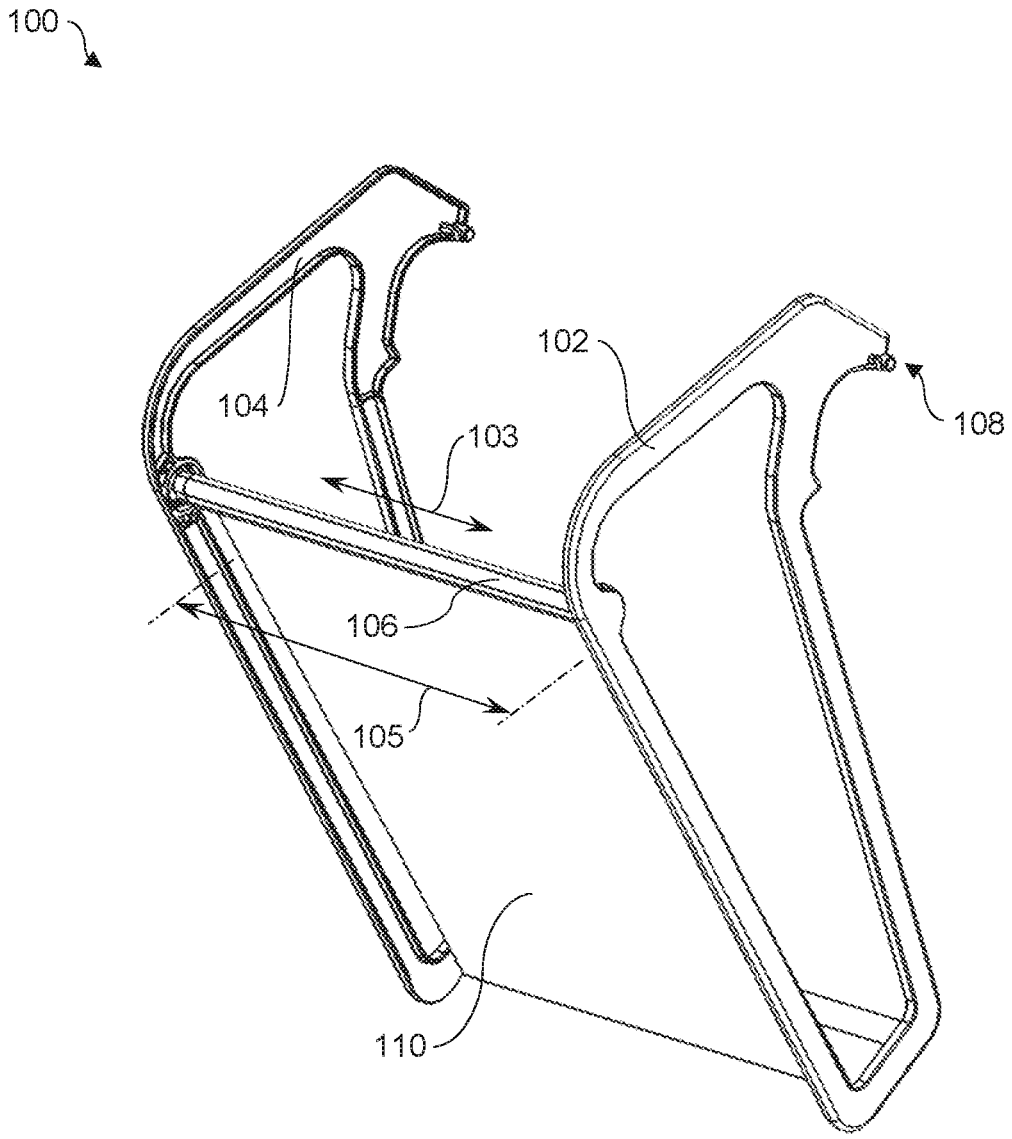
FIG. 1 is a perspective view of an example media catcher.

Imaging devices may perform imaging operations such as printing or copying with print media. Print media, for example, individual sheets of print media, may automatically enter an imaging device through a media input or from a media input tray, or may be manually loaded by a user. Print media which may be disposed on a continuous roll may be disposed near or within the imaging device and may be fed through the imaging device in a continuous fashion, and be cut to an appropriate size during or after the imaging operations are performed on or with such print media. Further, the print media may exit the imaging device through a media output after undergoing an imaging operation. After exiting the media output, print media may rest or be stored on a media output tray, or may fall into and be captured by a media basket, below the media output.

In some situations, an imaging device may be able to accommodate and perform imaging operations on or with print media in both an individual sheet format, as well as a continuous roll format. Imaging devices may also be able to accommodate print media of varying sizes, either in a sheet format, or cut from a continuous roll. Such imaging devices may deposit print media in either a media output tray, or a media basket, depending on the format and/or size or width of the print media. For example, sheet print media of a particular size or smaller may be stored on a media output tray after exiting the imaging device, while continuous roll print media, or print media having a larger size or width, may be deposited into a media basket after exiting the imaging device. This, in addition to the continuous roll print media generally having a larger size than individual sheet print media, may also be due to the personal preference of a user of the imaging device, in some situations.

Often, a media output tray may need to be extended from a stowed position to a deployed position in order for the media output tray to catch and retain print media exiting the imaging device. This may be due to a desire to maintain a minimal footprint of the imaging device when the output tray is not in use, but often it is so the output tray does not block the media basket and prevent print media from falling into and being captured by the media basket upon exiting the imaging device. Therefore, if a user desired to switch from utilizing a continuous roll of print media, or a larger size of print media, to utilizing individual sheets or a continuous roll of print media having a smaller size, then that user would have to manually extend the output tray to the deployed position before using the imaging device with the smaller print media. Similarly, if a user desired to switch from utilizing individual sheet print media or a continuous roll of print media having a smaller size, to utilizing a continuous roll of print media or sheets having a larger size, the user would have to manually move the output tray from the deployed position to the stowed position, such that the output tray no longer blocks the media basket, and the larger print media may fall into and be captured by the media basket upon exiting the imaging device. Thus, manual user interaction with the imaging device may be needed in order to switch between print media sizes and/or formats.

Accordingly, it may be desirable to provide an imaging device that is capable of performing imaging operations on or with print media of varying sizes or widths, in both an individual sheet format, as well as a continuous roll format. It may be further desirable that the imaging device may be able to switch between using one size or format to using another size or format, without necessitating manual interaction from a user, Imaging devices may sometimes include mechanisms to automatically deploy and stow media output trays, however such systems may be overly complex and costly. Further, some imaging devices may have more than one media output, for example, a media output for sheet print media, and another, separate media output for continuous roll print media. Such systems may also add unnecessary complexity and cost to the imaging device.

Implementations of the present disclosure provide media catchers which may be able to receive and retain print media upon the print media exiting an imaging device. Further, implementations described herein may be able to capture such print media without interfering with print media of a differing size or format from exiting the imaging device and being disposed in or captured by another type of device, e.g., a media basket. Additionally, example media catchers described herein may be utilized to allow an imaging device to switch between performing imaging operations on or with print media of differing sizes or formats without the need for user intervention, and without adding significant cost or complexity to the imaging device.

Referring now to FIG. 1, an example media catcher 100 is illustrated. Example media catcher 100 may include a first frame member 102 and a second frame member 104 spaced away from the first frame member 102 along a lateral direction 103. Media catcher 100 may also include a support member 106 extending from the first frame member 102 along the lateral direction 103 to the second frame member 104. The spacing of the first frame member 102 and the second frame member 104 may define a catcher width 105 of the media catcher 100. Additionally, the media catcher 100 may also include a device interface 108 disposed at a top end of a back side of the first frame member 102 or the second frame member 104. The device interface 108 may attach the media catcher 100 to an imaging device. The media catcher 100 may further include a catch panel 110, e.g., disposed on a front side, opposite the back side, of the first frame member 102 and the second frame member 104, and extending therebetween, to catch and support media.

Figure 2:
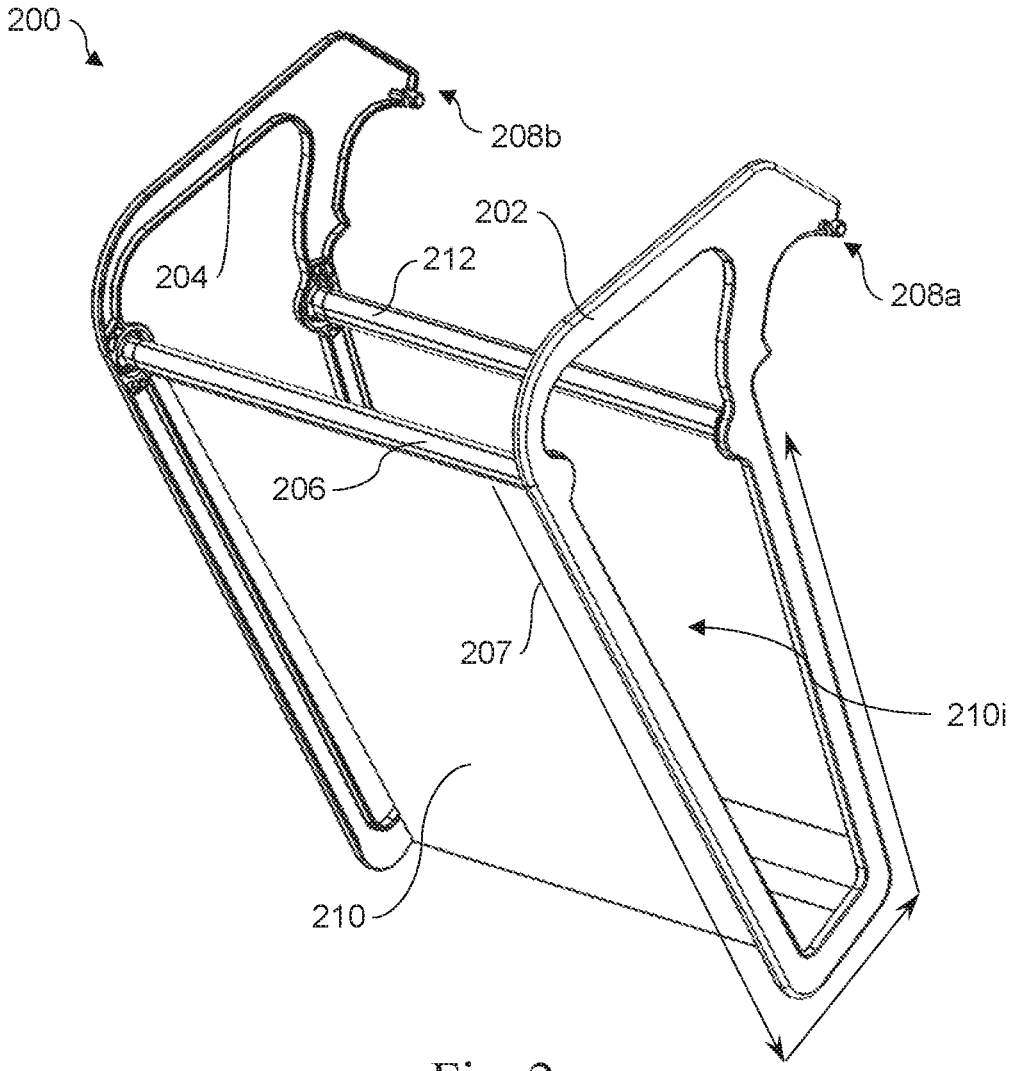
FIG. 2 is a perspective view of another example media catcher.

Referring now to FIG. 2, a perspective view of another example media catcher 200 is illustrated. Example media catcher 200 may be similar to example media catcher 100, described above. Further, the similarly-named elements of example media catcher 200 may be similar in function and/or structure to the respective elements of example media catcher 100, as they are described above. In sonic implementations, media catcher 200 may include a first frame member 202 and a second frame member 204. The first and second frame members 202 and 204 may have similar geometry and/or structure to one another, and, in some implementations, e.g., as illustrated in FIG. 2, may have a mirrored structure as to each other. In other implementations, the first and second frame members 202 and 204 may have differing structure from each other. The first and second frame members 202 and 204 may provide a rigid or semi-rigid structure and/or profile to the media catcher 200. The first and second frame members 202 and 204 may be constructed out of a polymer or plastic material in some implementations. In other implementations, the frame members may be constructed of another material, for example, a metallic material such as aluminum, magnesium, steel, and the like, or a composite material, for example, a carbon fiber that may be embedded within a resin.

In some implementations, the first and/or second frame members 202 and 204 may have or provide a front side, a bottom end, a back side, and a top end, each of which may define a corresponding portion of the media catcher 200 such that the media catcher 200 itself has a front side, a bottom end, a back side, and top end. In further implementations, one or both of the first and second frame members 202 and 204 may be minimalistic or skeletonized, i.e., may have frame structure and/or beams around a periphery of the respective frame member and may have an open, central portion. For example, each of the first frame member 202 and second frame member 204 may have structure and/or beams extending along the front side, bottom end, back side, and top end, surrounding a central, open portion. Such a skeletonized and minimalistic geometry may reduce the weight of each of the first and second frame members 202 and 204.

Media catcher 200 may further include a first support member 206 and a second support member 212. The first and second support members 206 and 212 may extend between the first frame member 202 and the second frame member 204. The first and second support members 206 and 212 may space apart the frame members from each other so as to define a catcher width of the media catcher 200. In some implementations, the first support member 206 may be disposed on a front side of the first and second frame members 202 and 204, and the second support member 212 may be disposed on a back side of the first and second frame members 202 and 204. In some implementations, the first and second support members 206 and 212 may be disposed in between the bottom end and the top end of the first and second frame members 202 and 204, and, in further implementations, the first and second support members 206 and 212 may be disposed closer to the top end than the bottom end, as illustrated. Each of the first and second support members 206 and 212 may be a rigid or semi-rigid member, beam, tube, or similar elongate component, and may include a polymer, metallic, composite, or other material suitable to provide a sufficient rigidity to the first and second support members 206 and 212.

The media catcher 200 may further include a catch panel 210 disposed and/or extending between the first and second frame members 202 and 204. In some implementations, the catch panel 210 may be a substantially planar or flat component in order to catch, retain, and support print media. In other implementations, the catch panel 210 may have another form or geometry that is suitable to catch print media, e.g., a geometry having steps, notches, tabs for alignment, etc. The catch panel 210 may be constructed, at least partially, of a fabric, mesh, netting, a polymer or plastic fabric, or other pliable material. In some implementations, the catch panel 210 may be formed of a rigid material instead of a pliable material. In further implementations, the catch panel 210 may include a laminate on one or both sides of the catch panel 210, e.g., sandwiching a fabric between layers of laminate. The laminate may provide a smooth texture to the catch panel 210 and may help prevent individual sheets of print media from catching on, or being obstructed by any small openings in a fabric or mesh material. In examples wherein the catch panel 210 is constructed of a rigid material, the media catcher 200 may sometimes omit the first and/or second support members 206 and 212, and instead the catch panel 210 itself may provide sufficient rigidity and structure between the first and second frame members 202 and 204, and to the overall media catcher 200.

The catch panel 210, in some implementations, may extend along the front side of the first and second frame members 202 and 204. In further implementations, the catch panel 210 may also extend around the bottom end of the first and second frame members 202 and 204, and, in yet further implementations, may also extend along the back side of the first and second frame members 202 and 204. Thus, in some implementations, the catch panel 210 may extend around, at least partially, a periphery of the first and second frame members 202 and 204, as illustrated by arrow 207 in FIG. 2. In further implementations, the catch panel 210 may extend from the first support member 206, around the periphery of the first and second frame members 202 and 204, to the second support member 212. Stated yet differently, the catch panel 210 may extend along the periphery of the first and second frame members 202 and 204 from the front side to the back side. The catch panel 210 may therefore have, or provide the media catcher 200, a structure resembling a pocket, basket, folder, or other component defining an internal cavity 210*i*. The internal cavity 210*i* may be sized suitably to receive and hold print media, or multiple sheets thereof.

The media catcher 200 may further include a first device interface 208*a* and a second device interface 208*b*, referred to collectively as device interfaces 208. The first and second device interfaces 208*a* and 208*b* may be disposed on the first and second frame members 202 and 204, respectively. In some implementations, the device interfaces 208 may be disposed on the back side of the respective frame members. Additionally or alternatively, the device interfaces may be disposed on the top end of the respective frame members. Thus, in some implementations, each of the device interfaces 208 may be disposed on the top end of the back side of the respective frame member.

The device interfaces 208 may be located in a suitable location, and/or have a suitable structure, to attach the media catcher 200 to an imaging device, and/or adjacent a media output thereof. In some implementations, the device interfaces 208 may have a post or other type of protrusion to engage with a mounting pocket of an imaging device, such that the media catcher 200 hangs from the imaging device near the media output thereof.

Figure 3A:
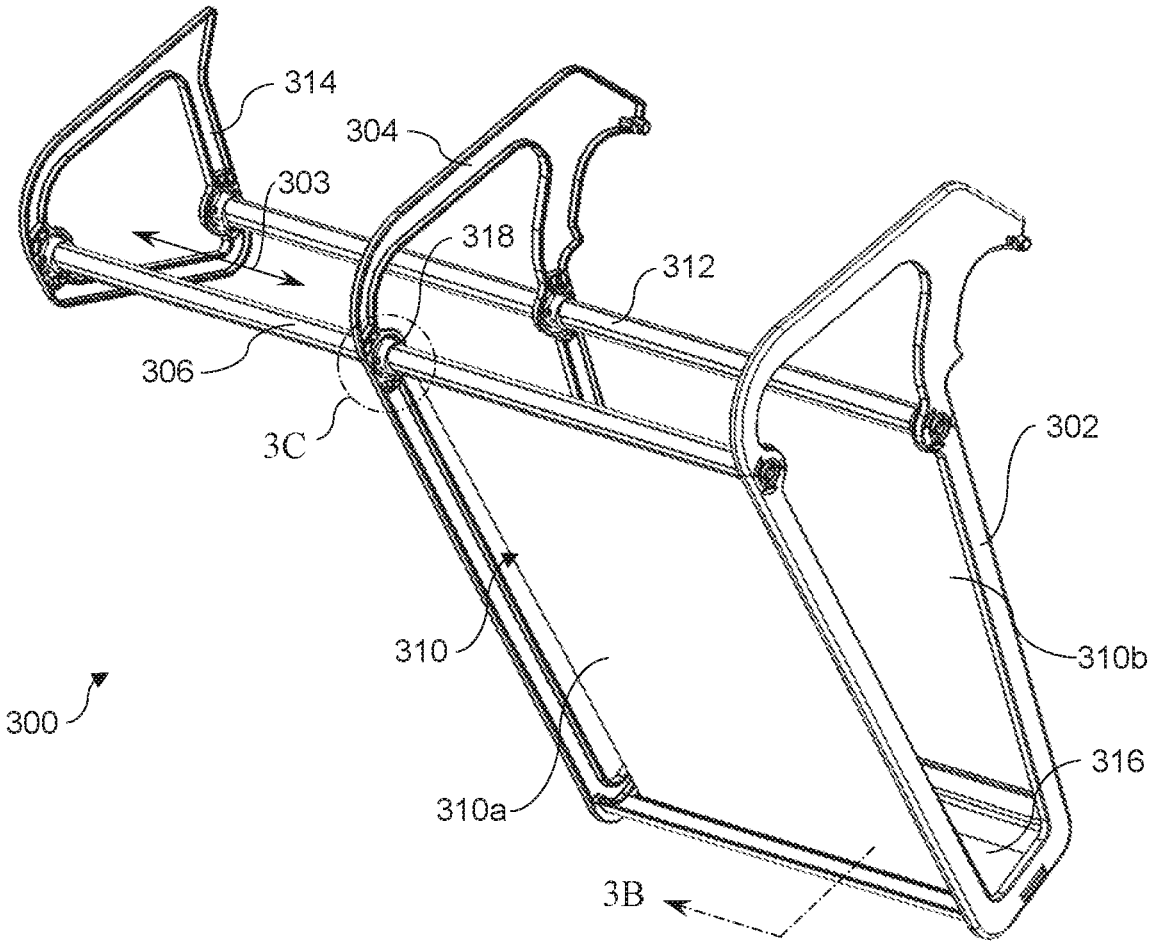
FIG. 3A is a perspective view of another example media catcher.

Referring now to FIG. 3A, a perspective view of an example media catcher 300 is illustrated. Example media catcher 300 may be similar to other example media catchers described above. Further, the similarly-named elements of example media catcher 300 may be similar in function and/or structure to the respective elements of other example media catchers, as they are described above. Media catcher 300 may include a first frame member 302, a second frame member 304, a first support member 306, a second support member 312, and a catch panel 310. The first and second support members 306 and 312 may extend along a lateral direction 303 from the first frame member 302 to the second frame member 312. Additionally, the media catcher 300 may also include a third frame member 314. The third frame member 314 may be spaced along the lateral direction from the second frame member 304. Accordingly, the first and second support members 306 and 312 may further extend along the lateral direction 303 from the second frame member 304 to the third frame member 314 to support the third frame member 314. Thus, the first and second support members 306 and 312 may support and align the first, second, and third frame members 302, 304, and 314 such that they are each aligned and substantially parallel to one another. In some implementations, the third frame member 314 may have a similar structure to either of the first and/or second frame members 302 and 304. In other implementations, the third frame member 314 may have a differing structure, or a structure matching just a portion of the first and/or second frame members 302 and 304, as illustrated in FIG. 3A.

The media catcher 300 may further include a bottom support 316 disposed at a bottom end of, and extending between, the first and second frame members 302 and 304. The catch panel 310 may extend from the first support member 306, around or through the bottom support 316, and to the second support member 312. The bottom support 316 is described in more detail below with reference to FIG. 3B.

The media catcher 300 may further include a plurality of lock nuts 318. Each lock nut 318 may engage one of the first and second support members 306 and 312 with one of the first, second, and third frame members 302, 304, and 314. The lock nuts 318 are described in more detail below with reference to FIG. 3C.

Figure 3B:
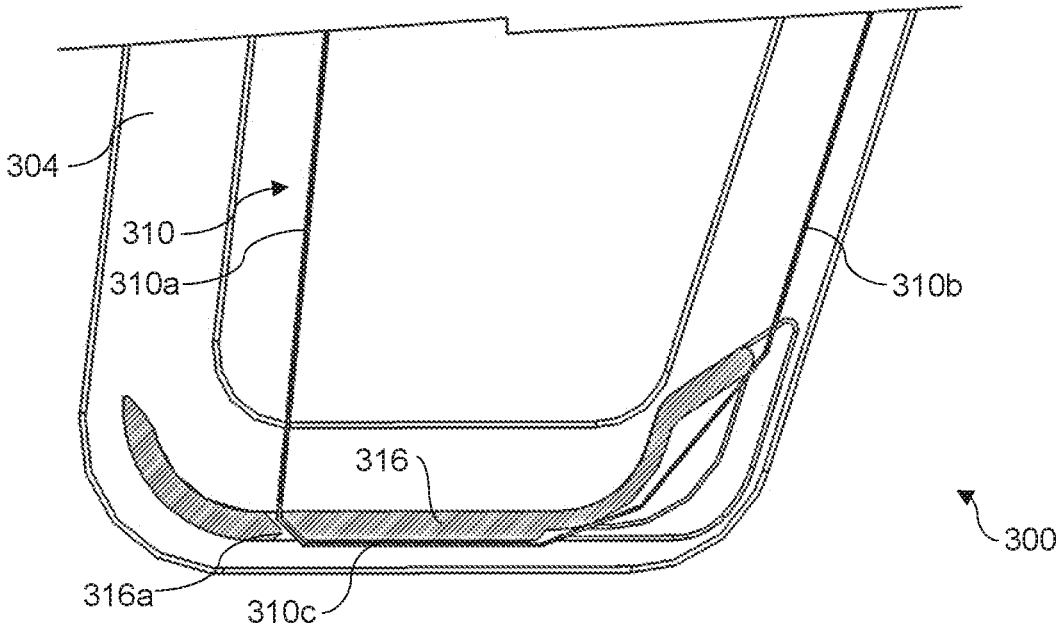
FIG. 3B is a cross-sectional view of an example media catcher.

Referring now to FIG. 3B, a cross-sectional view of example media catcher 300, taken along view line 3B of FIG. 3A, is illustrated. The bottom support 316 may be disposed at the bottom end of the first and second frame members 302 and 304. Only second frame member 304 is illustrated in FIG. 3B due to the sectional nature of the view. The bottom support 316 may attach and/or constrain the first and second frame members 302 and 304 to each other to provide additional strength and rigidity to the media catcher 300. As such, the bottom support 316 may be a rigid or semi rigid member extending between the first and second frame members 302 and 304. The bottom support 316 may be attached to the first and second frame members 302 and 304 in any fashion, for example, using clips, fasteners, friction fit protrusions and pockets, etc. In some implementations, the bottom support 316 may be co-molded, or molded with the first and second frame members 302 and 304 as a single, unitary component.

In some implementations, the bottom support 316 may provide tension or additional support to the catch panel 310. As such, the catch panel 310 may wrap around the bottom support 316 as it extends from a front side, around the bottom end, to a back side of the first and second frame members 302 and 304. In some implementations, the bottom support 316 may also include a slot 316*a* through which the catch panel 310 is to extend. For example, a front portion 310*a* of catch panel 310 may extend down the front side of the first and second frame members 302 and 304, into the slot 316*a* and through the bottom support 316. From there, a bottom portion 310*c* of the catch panel 310 may extend along the bottom end to the back side of the first and second frame members 302 and 304, where a back portion 310*b* of the catch panel 310 may then wrap around the back of the bottom support 316, and extend up the back side of the first and second frame members 302 and 304. In some implementations, the bottom support 316 may include additional slots (not shown), through which the catch panel 310 may extend or be woven for additional support.

Figure 3C:
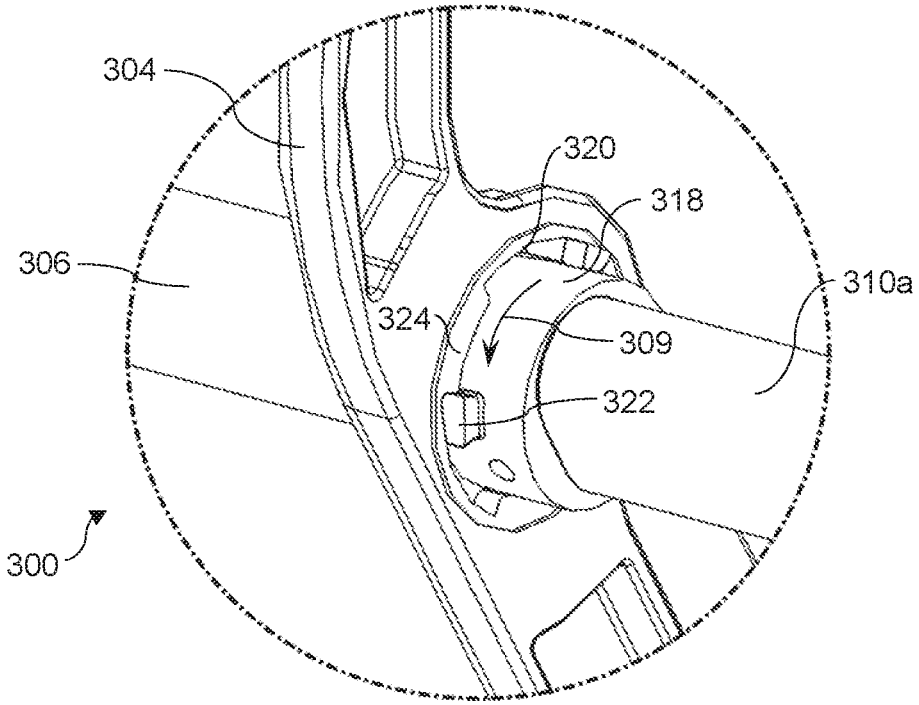
FIG. 3C is a detail view of an example media catcher.

Referring now to FIG. 3C, a detail view of example media catcher 300 is illustrated. As described above, the media catcher 300 may further include a plurality of lock nuts 318. Each lock nut 318 may be a rotational component which may engage with one of the first and second support members 306 and 312, and also with one of the first, second, and third frame members, 302, 304, and 314. The lock nut 318 illustrated in FIG. 3C is representative of one example implementation and function of the plurality of lock nuts 318. The illustrated lock nut 318 is engaged with the first support member 306 and the second frame member 304. In some implementations, the lock nut 318 may be a substantially round or cylindrical component which may engage with a complementary locking bore 320 of a respective frame member, e.g., as illustrated, the second frame member 304. The respective support member, e.g., as illustrated, first support member 306, referred to generally in this example as support member, may be inserted into or through, either partially or wholly, the respective lock nut 318. In some implementations, the support member may have an oblong or oval cross section, or another cross section which may prevent rotation of the support member relative to the lock nut 318, once inserted. Accordingly, the lock nut 318 may have a correspondingly-shaped internal bore, e.g., oval or oblong, to accommodate the support member.

Once the lock nut 318 is engaged with the support member, the lock nut 318 may be slid along a length of the support member, e.g., along the lateral direction, so as to insert into and engage with the locking bore 320 of the respective frame member. The lock nut 318, and, accordingly, the support member, may then be rotated along a locking direction, e.g., example locking direction 309, such that the lock nut 318 is locked into engagement with the locking bore 320 in a locked position. In the illustrated example, the lock nut 318 may include one or a plurality of locking lugs 322, each of which may engage with (in an interfering manner, for example) an associated locking ledge 324 of the locking bore 320. The engagement of the locking lug 322 with the locking ledge 324 may prevent, or make difficult, the inadvertent rotation of the lock nut 318 from the locked position.

In some implementations, the catch panel 310, or the front portion 310*a* thereof, may be wrapped around the support member, e.g., first support member 306, such that, upon the lock nut 318 locking into engagement with the locking bore 320, the rotation of the support member applies tension to the catch panel 310, thereby pulling the catch panel 310 into a tight engagement with the first support member 306, the bottom support 316, and the second support member 312. Therefore, in some implementations, the first and second support members, 306 and 312, are each attached to each of the first and second frame members, 302 and 304, by a separate lock nut 318, wherein the lock nuts 318 provide tension to the catch panel 310 when the lock nuts 318 are in the locked position.

Figure 4A:
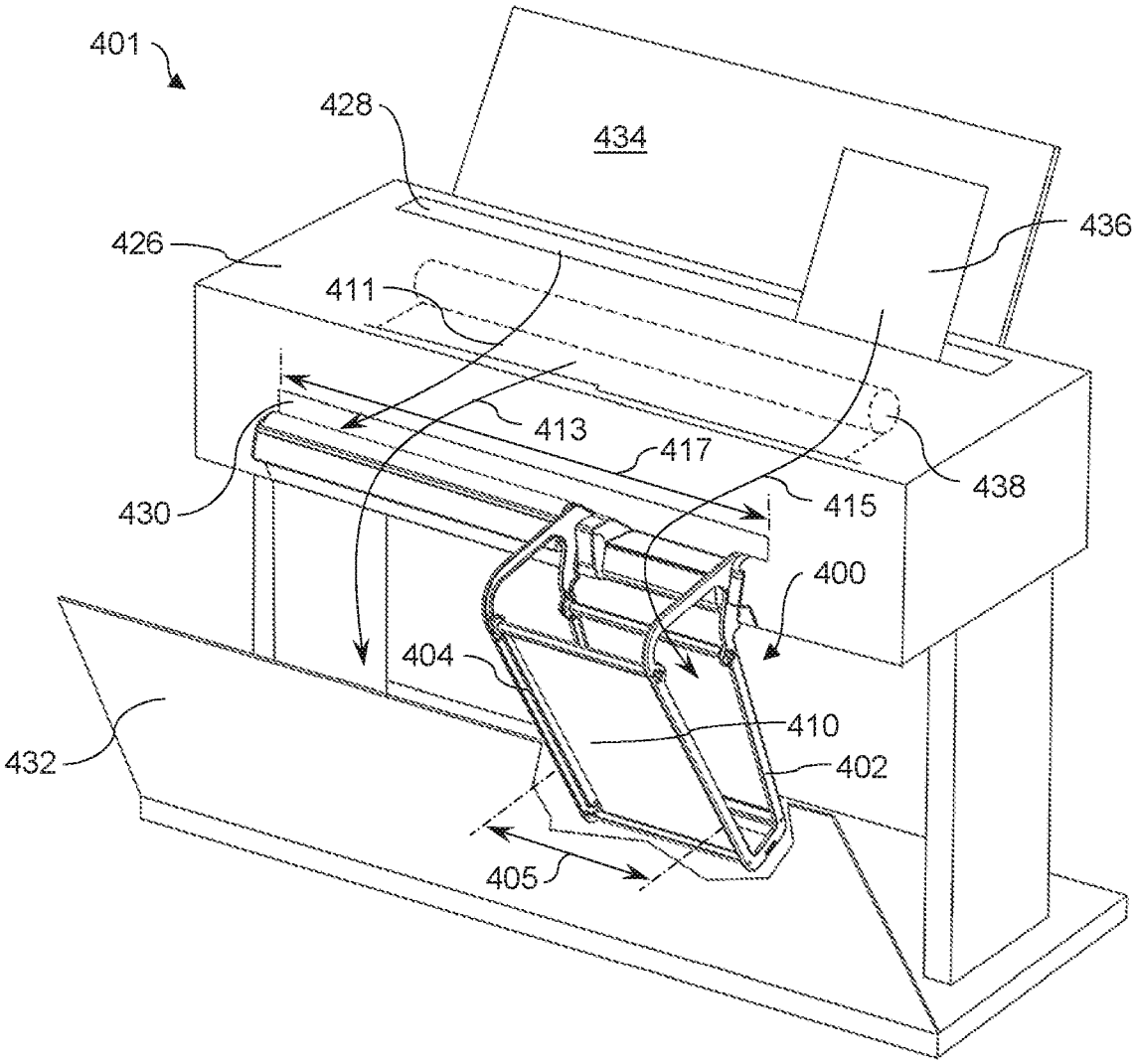
FIG. 4A is a perspective view of an imaging device having an example media catcher.

Referring now to FIG. 4A, a perspective view of an example imaging device 401 having an example media catcher 400 is illustrated. Example media catcher 400 may be similar to other example media catchers described above. Further, the similarly-named elements of example media catcher 400 may be similar in function and/or structure to the respective elements of other example media catchers, as they are described above. Example imaging device 401 may include an imaging component 426, a media input 428, and a media output 430. In some examples, the media input 428 may be disposed on or near a back side of the imaging component 426, and the media output 430 may be disposed on a front side of the imaging component, although other arrangements are contemplated. The imaging device 401 may further include a media path, e.g., general media path 411, which may extend from the media input 428, through the imaging component 426, to the media output 430. Print media may enter the imaging device 401 through the media input 428, travel through the imaging component 426 along the media path 411, wherein the imaging device 401 may perform an imaging operation on or with the print media, and then travel or be delivered out of the imaging device 401 through the media output 430.

In some implementations, the imaging device 401 may be an electronic device which may perform imaging operations on or with the print media. Examples of imaging operations include, but are not limited to, printing text or images on to the print media, copying or scanning the print media, faxing the print media, or other operations. Such imaging operations may be performed or carried out, at least partially, by the imaging component 426 of the imaging device 401. Examples of print media may include paper, cardboard, card stock, latex, vinyl, or other types of media with or upon which imaging operations may be performed.

In some implementations, print media may be in a roll format, such as a continuous roll of print media and represented by example print media roll 438. In such implementations, the print media roll 438 may be loaded into and disposed, at least partially, within the imaging component 426 of the imaging device 401. As such, print media roll 438 is illustrated in dotted lines. In other implementations, the print media roll 438 may be disposed outside of the imaging component. Print media may be pulled and unwound from the print media roll 438 in a continuous fashion while imaging operations are performed on or with the print media. The print media may then be cut to an appropriate or desired size from the print media roll 438 and delivered out of the imaging device 401 along media path 413, which may be a variation of general media path 411 suitable for delivering print media cut from a roll out of the imaging device 401, through the media output 430. Due to the relatively large size that print media from a continuous roll may sometimes have, upon exiting the media output 430, the print media cut from the print media roll 438 may fall into a media output basket 432 disposed beneath the media output 430. The media output basket 432 is shown as partially cut away so as to better illustrate the media catcher 400, further described below. The imaging device 401 may have the media output basket 432 disposed beneath the media output 430 specifically to catch print media delivered from the media output 430. The media output basket 432 may be sized sufficiently to catch and hold or retain print media cut from a print media roll 438 having a specific size, or may be able to catch and hold or retain print media cut from a variety of differently-sized print media rolls 438. Additionally, the media output basket 432 may be able to catch and hold individual sheets of print media fed into the media input 428 that are of a larger width or size than illustrated sheet print media 436.

In further implementations, print media may be in a sheet format, such as a stack of individual, discrete, and/or precut sheets of print media, represented by example sheet print media 436 mentioned above. Sheet print media 436 may be manually inserted, either a single sheet at a time, or a stack or ream of individual sheets at a time, into the media input 428. In other implementations, sheet print media 436 may be automatically delivered into media input 428 by another device or mechanism, e.g., an input tray or feeder. In some implementations, the imaging device 401 may include an input rest 434 on which print media may be held or supported until it is drawn into the media input 428. The sheet print media 436 may then be delivered or drawn into the imaging component from the media input 428 along media path 415, which may be a variation of general media path 411 suitable for delivering individual sheets of print media through the imaging component and out of the media output 430. The imaging component 426 may perform imaging operations on or with the sheet print media 436 as it is delivered through the imaging component 426.

The imaging device 401 may further include the media catcher 400 disposed adjacent to the media output 430. In some implementations, the media catcher 400 may be hanging from the imaging component 426 adjacent to the media output 430, and disposed above the media output basket 432. The media catcher 400 may include a catch panel 410 to catch and hold or retain print media delivered from the media output 430. In some implementations, the media catcher 400 may have a catcher width 405 suitable to receive and hold print media of a certain size or smaller. In further implementations, the media catcher 400 may extend along the media output 430 and have a catcher width 405 that is less than a lateral width 417 of the media output 430. Accordingly, the media catcher 400 may be able to catch and hold sheet print media 436 that is delivered out of the media output 430 in line with the media catcher 400 and having a width that is less than the catcher width 405. In contrast, while the imaging device 401 may be able to accommodate print media having a width greater than the catcher width 405 and up to the lateral width 417 of the media output 430, e.g., from print media roll 438, such print media will not fall into or be caught by the media catcher 400, and instead will travel over the media catcher 400 and fall into and be held by the print media basket 432. It should be noted that the imaging device 401 may be able to accommodate sheet print media that is wider than the catcher width 405. Such wider sheet print media, upon exiting the media output 430, may slide over first and second frame members 402 and 404 of the media catcher 400, and fall into the media output basket 432 instead of the media catcher 400. Similarly, the imaging device 401 may be able to accommodate print media rolls having a width less than the catcher width 405, or print media having a width less than the catcher width 405 that is cut from a print media roll. Such cut print media, if aligned with the location of the media catcher 400, upon exiting the media output 430, will pass in between the first and second frame members 402 and 404 and fall into the media catcher 400. Thus, the media catcher 400 may enable an imaging device to utilize and catch print media of varying sizes, regardless of originating from a continuous roll of print media or a stack of individual sheets of print media, without a user having to interact with the media output of the imaging device.

Referring now to FIG. 413, another perspective view of imaging device 401 having media catcher 400 is illustrated.

Figure 4B:
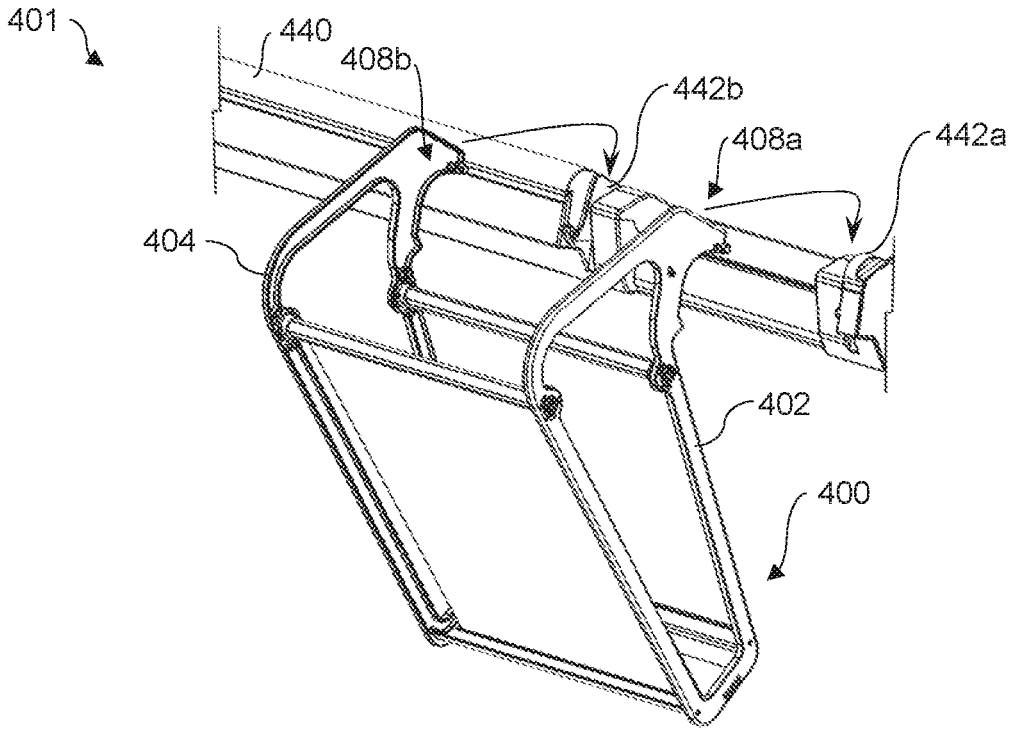
FIG. 4B is a perspective view of an imaging device having an example media catcher.

FIG. 4B illustrates one example of how the media catcher 400 may attach to the imaging device 401, or the imaging component 426 thereof. In some implementations, the media catcher 400 may further include a first device interface 408*a* disposed at an upper end of a back side of the first frame member 402, and a second device interface 408*b* disposed at an upper end of a back side of the second frame member 404. The first and second device interfaces 408*a* and 408*b* may be structured to engage with a first catcher interface 442*a* and a second catcher interface 442*b* of the imaging component 426, respectively. In some implementations, the first and second catcher interfaces 442*a* and 442*b* may be disposed on an output bar 440 of the imaging component, which may be disposed under, adjacent, or otherwise near the media output 430. The first and second device interfaces 408*a* and 408*b* may have a structure suitable to insert into and be retained by the first and second catcher interfaces 442*a* and 442*b*, respectively. Thus, in some implementations, the media catcher 400 may be attached to the imaging device 401 by being hung from the output bar 440 through the engagement of each device interface with a corresponding catcher interface, as illustrated by the example assembly arrows of FIG. 4B. In some implementations, the media catcher 400 is attached to the imaging component 426, or the output bar 440 thereof, at a distal end of the lateral width 417, as illustrated in FIG. 4A. In other implementations, the media catcher 400 may be attached to the imaging component 426, or the output bar 440 thereof, at a location central to the lateral width 417, or any location along the lateral width 417 that corresponds to a location along the media input 428 at which sheet print media 436 may be loaded, or any location along the lateral width 417 that corresponds to the location of a continuous roll of print media.

Figure 4C:
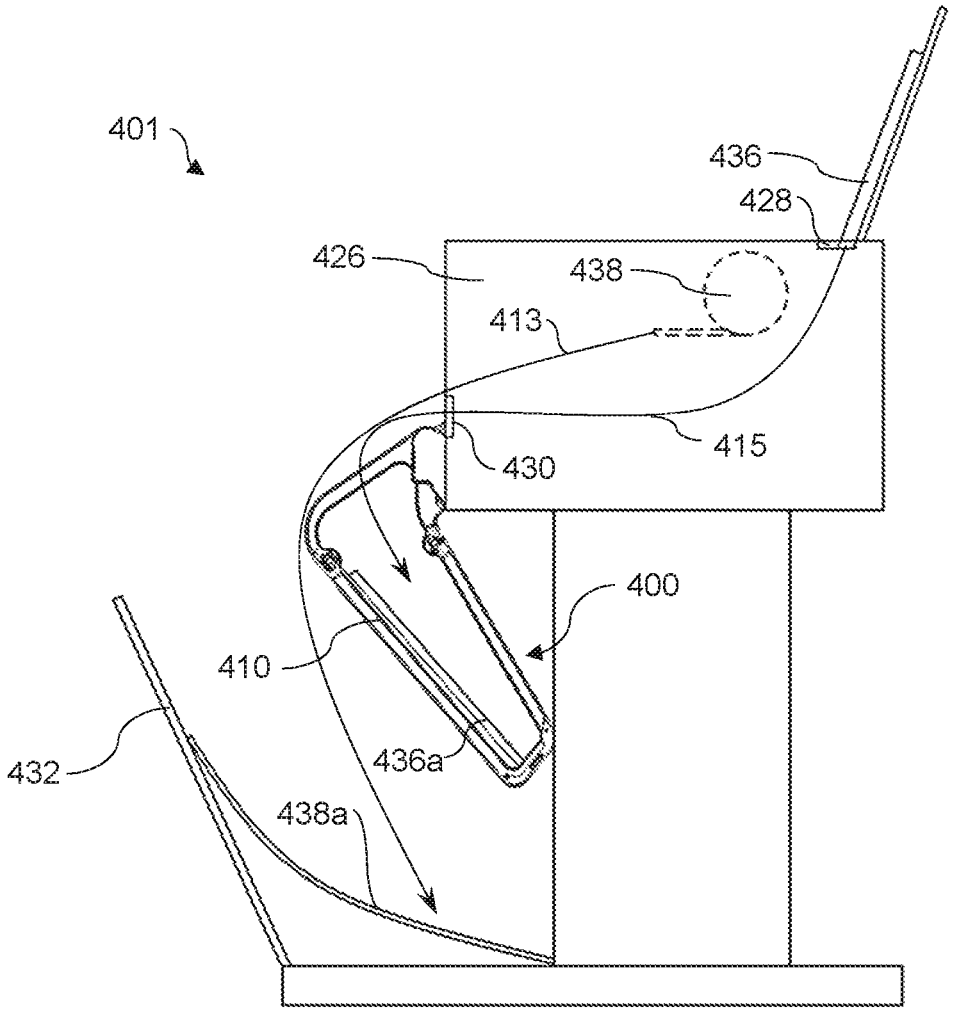
FIG. 4C is a side view of an imaging device having an example media catcher.

Referring now to FIG. 4C, a side view of example imaging device 401 having example media catcher 400 is illustrated, and the operation thereof is described. In some implementations, the imaging device 401 may be able to accommodate, or perform imaging operations on or with both print media from a print media roll 438 and sheet print media 436. When performing imaging operations on print media from print media roll 438, the imaging device 401 may deliver the print media from the media output 430. If the print media roll 438 has a width greater than the catcher width 405 of the media catcher 400, then upon exiting the media output 430, the print media from the print media roll 438 will travel along media path 413, over the media catcher 400, e.g., while being supported by a top end of the first and second frame members 402 and 404, and beyond the media catcher 400, thereupon falling into the media output basket 432 as illustrated. An example cut sheet of print media 438*a* from print media roll 438 is illustrated as being held by the media output basket 432. When performing imaging operations on sheet print media 436, the imaging device 401 may also deliver the sheet print media 436 from the media output 430. However, if the sheet print media 436 has a width less than the catcher width 405 of the media catcher 400, then upon exiting the media output 430, the sheet print media 436 will travel along media path 415, and fall into the media catcher 400, as illustrated. An example sheet of sheet print media 436*a* is illustrated as being held by the media catcher 400. It should be noted, as described above, if the sheet print media 436 has a width greater than the catcher width 405, the sheet print media 436 may travel over the media catcher, and instead fall into the media output basket 432. Similarly, if print media roll 438, or print media cut from print media roll 438, has a width smaller than the catcher width 405, the cut sheet of print media from the print media roll 438 may fall into and be retained by the media catcher 400, instead of travelling over and beyond the media catcher 400.

Stated differently, the imaging device 401 may perform imaging operations on or with a first print media, either sheet print media 436 or print media from print media roll 438, having a first width, narrower than the catcher width 405. Upon the first print media exiting or being delivered from the media output 430, the first print media is to be caught and held or retained by the media catcher 400. Further, the imaging device 401 may also or instead perform imaging operations on or with a second print media, either sheet print media 436 or print media from print media roll 438, having a second width, wider than the catcher width 405. Upon the second print media exiting or being delivered from the media output 430, the second print media is to travel over and be supported by the first frame member 402 and/or the second frame member 404 (and/or, further, the third frame member, in such examples) of the media catcher 400 such that the second print media bypasses the media catcher 400 and is caught and held or retained by the media output basket 432. Thus, the example imaging device 401 may be able to utilize print media of differing sizes and/or formats, and also be able to catch and retain such different media after performing imaging operations without the need for a user or other system to actively actuate an output tray or other retention device, or otherwise physically engage with the imaging device.

What is claimed is:

1. A media catcher, comprising:

a first frame member;

a second frame member spaced away from the first frame member along a lateral direction, thereby defining a catcher width of the media catcher;

a device interface disposed at a top end of the first frame member or the second frame member, the device interface to attach the media catcher to an imaging device; and a catch panel extending between the first frame member and the second frame member to catch and support media having a width within the catcher width, wherein an upper portion of the first and second frame members slopes downward when the media catcher is installed on the imaging device so as to guide print media having a width greater than the catcher width over the media catcher and beyond the catch panel.

2. The media catcher of claim 1, wherein the catch panel extends along the front side, around a bottom end, and along a back side of the first frame member and the second frame member.

3. The media catcher of claim 1, further comprising a first support member and a second support member extending between the first frame member and the second frame member.

4. The media catcher of claim 3, wherein the catch panel extends from the first support member, around a periphery of the first frame member and the second frame member, to the second support member.

5. The media catcher of claim 4, further comprising a bottom support disposed at a bottom end of, and extending between, the first and second frame members, wherein the catch panel is to extend from the first support member, around the bottom support, and to the second support member.

6. The media catcher of claim 3, wherein the first and second support members are each attached to each of the first and second frame members by a separate lock nut, wherein the lock nuts provide tension to the catch panel in a locked position.

7. The media catcher of claim 1, wherein the first and second frame members each have a skeletonized construction comprising a closed loop of frame defining a periphery of each frame member and an open space inside the closed loop.

8. The media catcher of claim 1, wherein the catch panel comprises a pliable material.

9. The media catcher of claim 1, wherein the catch panel comprises a fabric between layers of laminate.

10. The media catcher of claim 1, wherein the device interface is structured to hang the media catcher from an output bar of an imaging device.

11. A media catcher, comprising:

a first frame member;

a second frame member spaced away from the first frame member along a lateral direction;

a first support member extending between, and disposed on a front side of, the first frame member and the second frame member;

a second support member extending between, and disposed on a back side of, the first frame member and the second frame member;

a catch panel disposed in between, and extending along a periphery of, the first frame member and the second frame member from the front side to the back side; and a third frame member, the first and second support members further extending along the lateral direction from the second frame member to the third frame member.

12. The media catcher of claim 11, wherein the first and second frame members each have a skeletonized construction comprising a closed loop around a periphery of each frame member and an open space inside the closed loop.

13. The media catcher of claim 11, wherein the first and second support members are each attached to each of the first and second frame members by a separate lock nut, wherein the lock nuts provide tension to the catch panel in a locked position.

14. The media catcher of claim 11, wherein the third frame member matches only a portion of the first and second frame members.

15. An imaging device, comprising:

an imaging component;

a media input disposed on a back side of the imaging component;

a media output disposed on a front side of the imaging component, wherein a media path extends from the media input, through the imaging component, to the media output; and a media catcher hanging from the imaging component adjacent the media output, the media catcher comprising:

a first frame member;

a second frame member spaced from the first frame member along a lateral direction, thereby defining a catcher width of the media catcher;

a first support member extending between the first frame member and the second frame member; and a catch panel extending around a periphery of the first and second frame members, the catch panel to catch and retain print media having a width within the catcher width delivered from the media output, wherein an upper portion of the first and second frame members aligns with and extends the media path from the media output to a position beyond the catch panel so as to guide print media having a width greater than the catcher width over the media catcher so that media with a width greater than the catcher width are not caught in the media catcher.

16. The imaging device of claim 15, wherein the media catcher further comprises a device interface on a back side of the first support member or the second support member to attach the media catcher to the imaging component adjacent the media output.

17. The imaging device of claim 15, wherein the media catcher is attached to the imaging component at a distal end of the media output.

18. The imaging device of claim 15, wherein the media catcher extends along the media output and has a catcher width less than a lateral width of the media output.

19. The imaging device of claim 18, wherein first print media having a first width, narrower than the catcher width, is to be caught and retained by the media catcher upon being delivered out of the media output.

20. The imaging device of claim 19, wherein second print media of a second width, wider than the catcher width, is to travel over and be supported by the first frame member or the second frame member of the media catcher such that the second print media bypasses the media catcher and is caught and retained by a media output basket upon being delivered from the media output.

* * * * *